United States Patent [19]

Knudson

[11] 3,967,430

[45] July 6, 1976

[54] BUILDING METHOD

[76] Inventor: Gary A. Knudson, 7485 Upham Court, Arvada, Colo. 80002

[22] Filed: Nov. 27, 1974

[21] Appl. No.: 527,528

Related U.S. Application Data

[62] Division of Ser. No. 408,942, Oct. 23, 1973, Pat. No. 3,902,288, which is a division of Ser. No. 226,173, Feb. 14, 1972, abandoned.

[52] U.S. Cl. ..... 52/745; 29/200 B; 29/243.5; 29/509; 52/748

[51] Int. Cl.[2] ..... E0 4G 21/14

[58] Field of Search ..... 29/509, 200 B, 243.5; 52/86, 758 D, 748, 588, 745

[56] References Cited

UNITED STATES PATENTS

| | | | |
|---|---|---|---|
| 354,390 | 12/1886 | Caldwell | 52/758 D X |
| 1,925,417 | 9/1933 | Swank | 52/758 D X |
| 2,038,437 | 4/1936 | McCoy | 29/509 |
| 2,062,160 | 11/1936 | Calkins et al. | 52/588 X |
| 3,111,788 | 11/1963 | Ouellet | 52/86 X |
| 3,276,171 | 10/1966 | Brown | 52/86 |
| 3,381,432 | 5/1968 | Brandwein | 52/86 X |
| 3,511,011 | 5/1970 | Straus | 52/748 X |
| 3,540,116 | 11/1970 | Drahos et al. | 29/509 X |
| 3,609,845 | 10/1971 | Taylor | 29/200 B |

*Primary Examiner*—Charlie T. Moon
*Attorney, Agent, or Firm*—Ancel W. Lewis, Jr.

[57] ABSTRACT

A generally box-shaped building panel suitable for use in multiple to form both an arched roof and the end walls in a self-supporting building. The basic panel is arranged whereby one panel is connected to the other by placing an inturned flange of one panel through a bottom opening in a connecting channel portion of the other panel and folding a downturned terminal portion of the other panel under the inturned flange portion of the one panel. The roof panel has transverse corrugations in the bottom and sides, the side corrugations being tapered. An inverted connecting channel is provided at each end of the roof to which the upper end of the end walls are secured and the lower extremities of the roof and wall panel assemblies are anchored to a foundation. Apparatus for forming the corrugations includes a single drive for the corrugating rollers for both the sides and bottom of the panel with a cam clutch in the drive train which allows the rollers forming the bottom corrugations to pull the panel through the corrugating rollers for the side portions while the latter rollers idle.

3 Claims, 17 Drawing Figures

BUILDING METHOD

This is a division of application Ser. No. 408,942 filed Oct. 23, 1973, now U.S. Pat. No. 3,902,288 which is a division of Ser. No. 226,173 filed Feb. 14, 1972, now abandoned.

This invention relates to improvements in building panels, apparatus for forming building panels and self-supporting buildings and building methods.

A building made of a plurality of panels which can be fabricated and assembled at the job site affords many advantages over the presently available conventional buildings made of brick, stone or concrete. Fabricated building panels have heretofore been provided which were capable of being assembled into a self-supporting or free-standing building characterized by the absence of intermediate trusses, supports and columns. Prior building panels of this type have been shaped from synthetic and sheet metal materials but the larger spans have employed sheet metal. A number of the prior building panels require additional fastening members to join two panels together. Other assemblies require the forming of holes therein to accomplish fastening. Another disadvantage of other known building panels is that as a result of the shaping, they are under tension and have a tendency to twist or become deformed under load.

Accordingly, it is an object of the present invention to provide an improved building panel for use in forming the roof and walls in self-supporting buildings and the like.

Yet another object of this invention is to provide an improved building panel preferably formed from a strip of sheet metal or the like having a unique generally box-shaped cross-section adapted to join with an adjacent similar building panel without the necessity of an additional connecting member between the two building panels.

Another object of this invention is to provide an arched panel and apparatus for forming said arched panel having corrugations in the bottom and in the sides for maximum strength under load with a minimum of internal stress as a result of being roll-formed from a flat sheet.

Still another object of this invention is to provide a novel self-supporting building and method which greatly reduces the material cost and time of assembly from that of conventional building practices.

In a preferred form of the present invention there is provided a generally box-shaped panel used in multiples in an arched roof and the end walls in a self-supporting building. The basic panel has relatively deep side wall portions and an inturned flange on one side with a downturned terminal portion on the other side forming an inverted connecting channel with a bottom opening whereby one panel is connected to the other by placing the inturned flange of one panel through the bottom opening in the other panel and folding the downturned terminal portion of the other panel under the inturned flange portion of the one panel. The roof panel is further provided with transverse corrugations in the bottom and sides, the side corrugations being tapered toward the upper ends. An inverted connecting channel is provided at each end of the roof to which the upper end of the end wall panels are secured and the lower ends of the roof and end wall panels are anchored to the foundation. The apparatus for forming the corrugations includes a single drive shaft coupled to corrugating rollers for both the sides and bottom of the panel. A cam clutch coupled to the side rollers allows the rollers forming the bottom to pull the panel through the corrugating rollers for the side portions and the other corrugating rollers to idle.

Other objects, advantages and capabilities of the present invention will become apparent as the description proceeds taken in conjunction with the accompanying drawings, in which.

Figure 1:
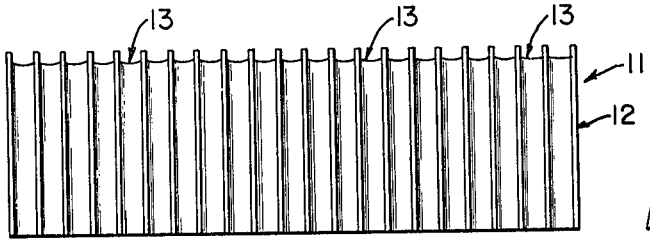
FIG. 1 is a side elevation view of a self-supporting building embodying features of the present invention.
Figure 2:
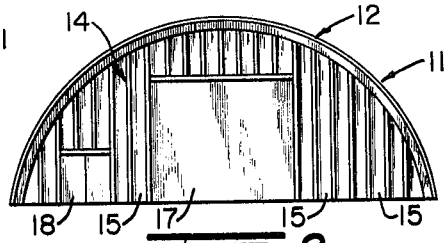
FIG. 2 is an end elevational view of the building shown in FIG. 1.
Figure 4:
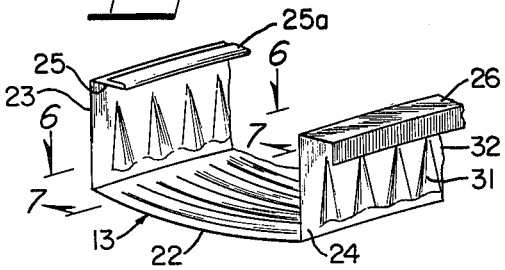
FIG. 4 is a perspective view of a length of an arched roof building panel.

Referring now to the drawings, there is shown in FIG. 1 a building 11 having an arched roof 12 comprised of an assembly of roof panels 13 and an end wall 14, at each end comprised of an assembly of vertical end wall panels 15. The building 11 is shown as having a larger door 17 in one end wall 14 and a smaller door 18 in the same end wall to afford access.

Figure 3:
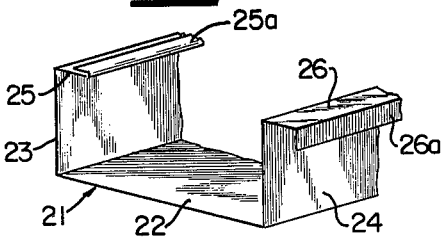
FIG. 3 is a perspective view of a length of a building panel embodying features of the present invention.

The building panels for building 11 are made from a basic generally box-shaped panel 21 shown in detail in FIG. 3 which has a flat base or bottom portion 22, a pair of spaced upright side portions 23 and 24 projecting upwardly from the opposite marginal edges of and in a direction transverse to the flat bottom portion 22, an upper inturned flange portion 25 projecting inwardly from the upper marginal edge of and in a direction transverse to the side portion 23. An upper outturned flange portion 26 projects outwardly from an upper marginal edge of and in a direction transverse to the side portions 24 and has a downturned terminal portion 26*a* at the outer marginal edge thereof. The inturned flange portion 25, has a terminal section 25*a* bent back toward the side portion 23 to provide a reverse bend or fold and a double thickness. The outturned flange portion 26 is bent downwardly to provide a straight, downturned terminal portion 26*a* providing an inverted, generally U-shaped connecting channel with a bottom opening. The bottom opening formed by the outturned flange portion 26 is of greater width than the inturned flange portion 25 so that it will receive the inturned flange portion of the next adjacent panel directly through the bottom opening. This facilitates an easy assembly of the panels. The basic panel 21 is made by roll forming a flat strip of sheet metal into the shape shown in FIG. 3 and may utilize the method and machine disclosed in my U.S. Pat. No. 3,529,461 with the necessary modifications to form the specific flange shapes shown in FIG. 3.

The roof panel 13 is made by taking the basic panel 21 and forming transverse corrugations in each of the side portions 23 along the length thereof, the corrugations being comprised of a series of alternative grooves and ridges along each side portion which are designated by numerals 31 and 32, respectively. The corrugations in the side portions extend the full length of the panel and are tapered toward the top, their being deepest adjacent the marginal edge of the bottom portion and decreasing in depth upwardly along the side portions to a point below and spaced from the upper marginal edge of the side portion. The tapered corrugations in the side portions provide the greatest strength at the base and leave the upper edge of the side portions substantially smooth or non-corrugated and this arrangement leaves the formed panel in a stable condition with no internal tension or tendency to twist which might otherwise exist due to the forming of the arch in the bottom portion. A further advantage of the side corrugations is that adjacent corrugations mesh with one another to prevent relative longitudinal movement between two side-by-side panels. Transverse corrugations are also formed in the bottom portions which are composed of a series of alternating grooves 33 and ridges 34. The corrugations in the bottom portion provide the desired arch in the roof panels.

The vertical end wall panels 15 may take the form of the basic panel of FIG. 3 or may be strengthened by providing a pair of upwardly protruding rib portions 36 and 37 in the bottom wall extending along the panel.

In the method of assembly, two roof panels side-by-side the inturned flange portion 25 of one panel is inserted into or received through the bottom opening of the connecting flange of the other panel and the corrugations of the adjacent side portions mesh with one another. The downturned terminal portion 26*a* is folded back under the inturned flange portion 25 throughout the length of the panel using a suitable crimping tool leaving a rounded bend or fold along the inner side edge thereof.

By way of illustration and not by way of limitation a typical arched roof panel 13 as above described suitable for a span up to 100 feet has the following dimensions:

| | |
|---|---|
| Width of bottom portion | 12" |
| Depth of side portion | 4" |
| Gauge of material | 20 (0.36" thickness) |
| Depth of corrugations | ¼" to ⅛" |

The side portions of the panel are considerably taller or of more depth than those heretofore provided and have been found to permit a considerably greater building span without additional supports. The provision of flange at the upper marginal edges makes it a box-shaped configuration with four corners and distinguishes it from the typical channel or basic U-shaped panel and affords considerably greater load strength. The connection between panels is water and weather proof. No bolts or holes or third member fasteners are required. The intermeshing side corrugations restrict movement in both the vertical and horizontal planes under load.

In the preferred building construction using the arched roof panels 13 above described, a pair of parallel concrete sub-footings form the foundation, one being represented at 41 and set in place at spaced intervals along the footing and external above the top surface of the sub-footing 41. An angle iron 43 is mounted on the sub-footing and is set at the proper angle to the end of the panel to and secured to the anchor rod 42. The roof panels are assembled side-by-side as above-described with the lower extremities thereof being at rest on the angle iron 43. The lower extremities are temporarily secured to the angle iron by wires or bolts (not shown). An upper footing and floor portion and floor section 44 is then poured around the lower portion of the lower extremities of the assembled roof panels to secure them in place and seal against the weather.

Figure 12:
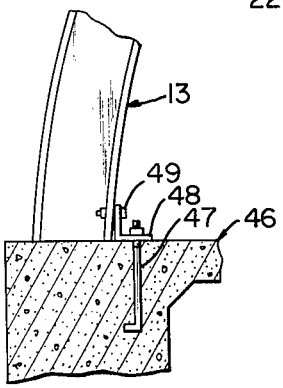
FIG. 12 is a fragmentary vertical sectional view showing the attachment of the end wall building panel to the roof and the foundation.
Figure 6:
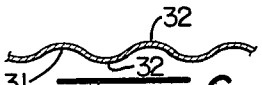
FIG. 6 is a sectional view through lines 6—6 of FIG. 4.
Figure 7:
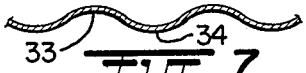
FIG. 7 is a sectional view through lines 7—7 of FIG. 4.
Figure 5:
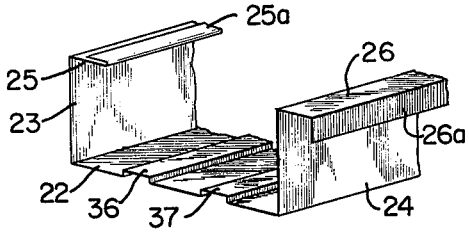
FIG. 5 is a perspective veiw of a length of an end wall building panel.
Figure 8:
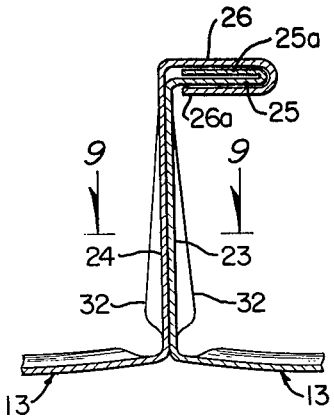
FIG. 8 is a transverse section view showing parts of an assembly of a pair of adjacent roof panels shown in FIG. 4.
Figure 9:
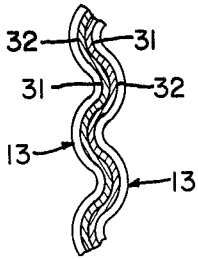
FIG. 9 is a sectional view taken along line 9—9 of FIG. 8.
Figure 14:
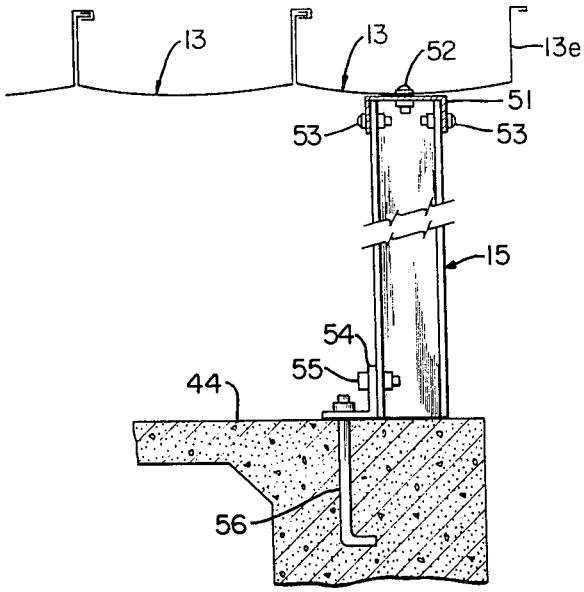
FIG. 14 is an elevation view showing the attachment of the end wall to the foundation and to the end roof panel.
Figure 13:
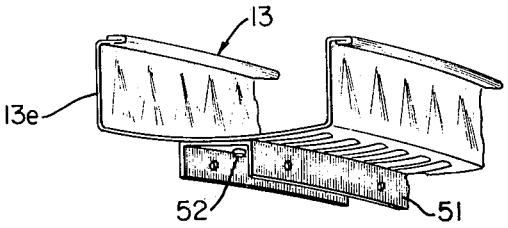
FIG. 13 is a perspective view of a length of a roof panel member located at the end of the building having a depending fastening channel for attachment to the upper end of the vertically disposed end panel member.
Figure 11:
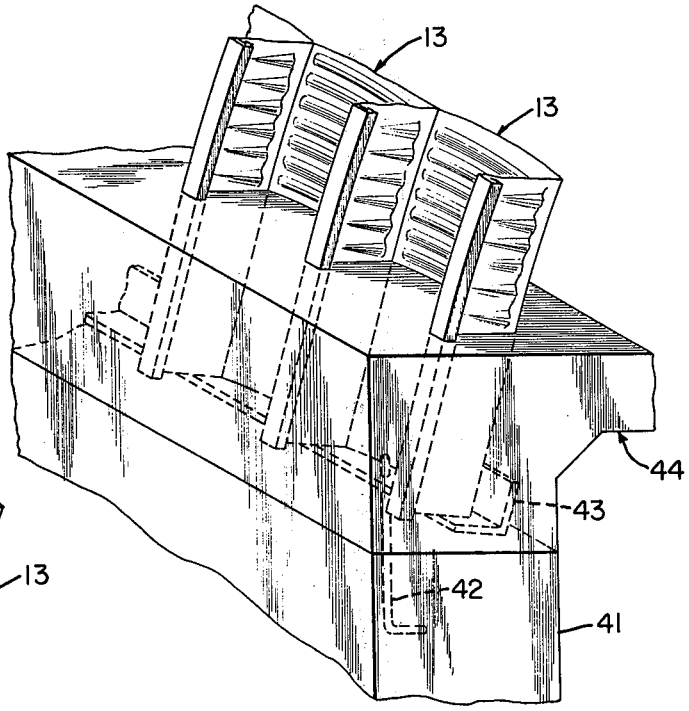
FIG. 11 is a fragmentary perspective view of the lower end of a roof building panel of FIG. 10 in which the upper part of the foundation and floor have been poured.
Figure 10:
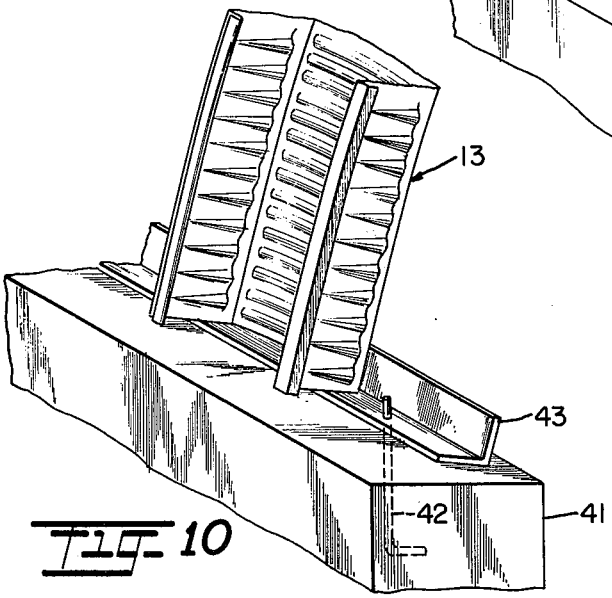
FIG. 10 is a fragmentary perspective view showing the support of the lower end of a pair of roof building panels on an angle iron disposed on a subfoundation prior to pouring of an upper part of the foundation.

An alternate arrangement for supporting and anchoring the roof panels is illustrated in FIG. 12 where a footing and floor section 46 has the anchor bolts 47 embedded therein and projecting upwardly therefrom. An angle iron 48 is fastened to the anchor bolt and then fastened to the panels as by a bolt and nut fastener represented at 49.

In the building shown, the roof panel at each end or the end roof panel 13*e* has an inverted U-shaped channel member 51 secured to the underside thereof as with bolt and nut fasteners 52 at spaced intervals. The end wall panels are inserted individually or as an assembly into the channel member 51 at the top and fastened thereto as with bolt and nut fasteners 53 along both sides. The bottom of the end wall panels rest on the foundation floor 44 and are fastened to an angle iron 54 with a bolt and nut fastener 55 which is anchored to anchor bolts 56 embedded in the floor.

Figure 16:
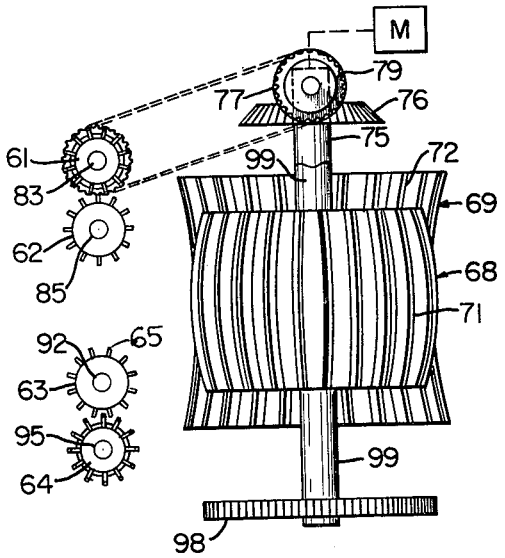
FIG. 16 is a top plan view of the machine of FIG. 15.
Figure 15:
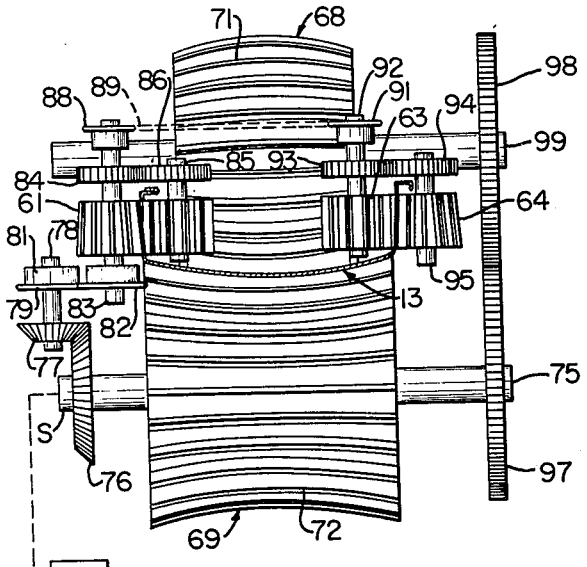
FIG. 15 is a front view of the end showing the shaping part of a machine suitable for forming corrugations with both the bottom and sides of the arched roof panel.
Figure 17:
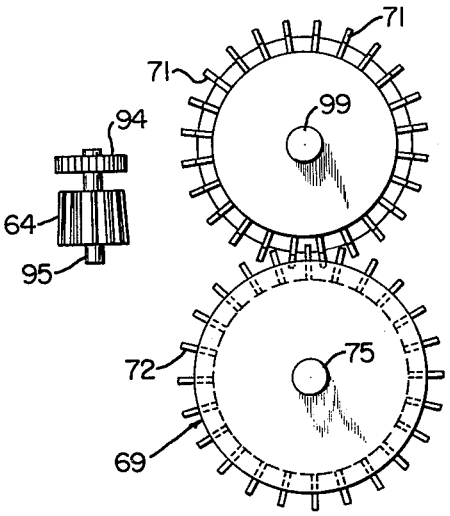
FIG. 17 is a side elevational view of the machine of FIGS. 15 and 16.

In a preferred form of apparatus for forming the crimps or corrugations in the side and bottom portions of the roof panels 13 there is shown in FIGS. 15 through 17 a pair of corrugating rollers 61 and 62 for one panel side portion and a pair of corrugating rollers 63 and 64 for the other panel side portion. The outer roller of each pair is tapered toward the upper end or upwardly convergent and the inner roller of each pair is tapered toward the lower end and is downwardly convergent in contour so as to form the tapered side corrugations in the panels. Each side roller has a plurality of radially extending circumferentially spaced fingers 65, with the fingers of one of the pair meshing with the fingers of the other of the pair so that as the sheet metal is passed between a pair, the tapered alternate grooves and ridges are pressed therein with the continuous feed or movement of the panel therethrough.

Following the side rollers there is provided upper and lower corrugating rollers 68 and 69, respectively, for corrugating the bottom portion 22 of the panel. The upper roller 68 has a convex contour and the lower roller 69 has a complementary concave contour. The upper roller 68 has a plurality of radially extending circumferentially spaced fingers 71 which mesh with radially extending circumferentially spaced fingers 72 on the lower roller to form the corrugations as the bottom of the panel is passed therethrough.

The drive train for the side rollers 61, 62, 63 and 64 and the upper and lower rollers 68 and 69 respectively is arranged to be driven by a single main drive shaft S coupled to a single conventional drive motor M. The main drive shaft S is coupled to or a part of a shaft 75 extending from the opposite ends of the lower corrugating roller 69 and has a beveled gear 76 carried on shaft 75 meshing on end with a smaller beveled gear 77 carried on a vertical shaft 78. Shaft 78 is coupled to a sprocket gear 79 carried by a cam clutch coupling 81. The sprocket gear 79 meshes with a sprocket 82 fixedly secured to a shaft 83 secured to the outer side corrugating roller 61. The other end of shaft 83 has a gear 84 meshing with a gear 85 on a shaft 86 connected to the inner corrugating roller 62, rollers 61 and 62 being turned in opposite directions. The upper end of the shaft 83 carries a sprocket 88 coupled by a chain 87 to a sprocket 71 on the shaft 92 connected to the outer corrugating roller 64.

The cam clutch 81 coupling between the shaft 78 and gear 79 on the outer roller is a conventional device similar to a bearing which permits the main shaft M to drive the side corrugating rollers via the cam clutch coupling and allow the side rollers to rotate freely of the main drive once the outer sprocket 79 rotates faster than the inner shaft 78 in an overrunning action. The end of shaft 75 opposite shaft 73 connected to the upper roller has a gear 97 which meshes with gear 98 on a shaft.

In the forming of the corrugations the basic panel 21 shown in FIG. 3 is passed first through the pairs of side corrugating rollers and then between the upper and lower rollers. Initially, the side rollers are positively driven via the gear train to draw the panel therethrough. As soon as the panel reaches the upper and lower rollers 68 and 69, the panel is drawn faster than the side rollers are running so that they now idle and the panel is drawn through only by the power supplied to upper and lower rollers.

It is therefore to be understood from the foregoing description that various changes and modifications may be made therein without departing from the spirit and scope of the invention as defined by the appended claims.

What is claimed is:

1. In a method of making a building by connecting together a pair of adjacent individual building panels the steps of:

providing a pair of generally U-shaped panels, each said panel having a pair of spaced parallel side portions, one panel having an outturned flange portion extending outwardly of the upper marginal edge and in a direction substantially perpendicular to one of said side portions and a downturned terminal portion forming an inverted channel extending the full length thereof and the other panel having an inturned flange portion extending inwardly of the upper marginal edge and in a direction substantially perpendicular to the other of said side portions positioned in the inverted channel and extending the full length thereof; and turning substantially the entire length of the downturned terminal portion sharply back in a direction substantially parallel to said outturned flange portion and up against the underside of the inturned flange portion to the extent necessary to engage a substantial portion of the width of said inturned flange portion to form a continuous seam connection along the pair of panels.

2. In a method of making a building from a plurality of building panels, the steps of providing a plurality of building panels each building panel having a generally box-shaped transverse cross-section with four corners having a bottom portion, said bottom portion having transverse corrugations extending along the length thereof, said bottom portion having a downwardly extending bow, a pair of spaced upright side portions projecting upwardly from the opposite marginal edges of and in a direction substantially perpendicular to said bottom portion and arranged in planes parallel to one another, said upright side portions having side corrugations and being at least three inches and above in height and unobstructed between said side portions, an inturned flange portion projecting laterally inwardly from the upper marginal edge of and in a direction substantially prependicular to one of said side portions, an outturned flange portion projecting outwardly from the marginal edge of the other of said side portions in a direction substantially perpendicular to the other of said side portions, said outturned flange portion having a flat terminal flange-locking portion extending substantially perpendicular to said outturned flange portion to provide an inverted connecting channel with a bottom opening, a bottom portion, a pair of spaced upright side portions, and inturned flange portions projecting inwardly from one of the side portions and outturned flange portion projecting outwardly from the other said side portions having a downturned terminal portion forming an inverted connecting channel with a bottom opening, said bottom opening being of a greater width than the said inturned flange, the steps of:

disposing a pair of the panels side by side and positioning the outturned flange portion of one panel over the inturned flange portion of the other panel and with abutting side corrugations in a meshing relationship; and folding the downturned terminal portion of the one panel inwardly under and against the underside of said inturned flange portion of the other panel to form a continuous seam connection along said inturned and outturned flange portions of the adjacent sides of said pairs of panels to interlock adjacent panels side by side to hold the abutting panels against relative lateral, vertical and longitudinal movement.

3. In a method of making a building as set forth in claim 2 further including the step of anchoring the lower extremities of the connected panels to support them in an upright position.

* * * * *